US005186018A

United States Patent [19]

van Ditzhuijzen et al.

[11] Patent Number: 5,186,018

[45] Date of Patent: Feb. 16, 1993

[54] COOLING SYSTEM FOR COOLING A MOVING METAL STRIP

[75] Inventors: Gustaaf A. J. M. van Ditzhuijzen, Heemstede; Philip A. Bond, Heemskerk, both of Netherlands

[73] Assignee: Hoogovens Groep BV, Ijmuiden, Netherlands

[21] Appl. No.: 718,284

[22] Filed: Jun. 20, 1991

[30] Foreign Application Priority Data

Jun. 27, 1990 [NL] Netherlands ..... 9001462

[51] Int. Cl.[5] ..... C21D 1/62; C21D 1/54; B21B 27/06

[52] U.S. Cl. ..... 62/374; 72/201; 266/113

[58] Field of Search ..... 62/373, 374, 63, 64; 72/201; 266/111, 113, 114; 148/153, 157

[56] References Cited

U.S. PATENT DOCUMENTS

| | | | |
|---|---|---|---|
| 3,546,911 | 12/1970 | Lenz | 72/201 |
| 4,300,376 | 11/1981 | Wilmotte | 72/201 |
| 4,305,765 | 12/1981 | Wilmotte et al. | 266/113 X |
| 4,318,534 | 3/1982 | Thome et al. | 266/113 |
| 4,415,143 | 11/1983 | Ebata | 266/112 |
| 4,423,856 | 1/1984 | Takahashi et al. | 72/201 X |
| 4,497,180 | 2/1985 | Graham | 62/63 |
| 4,570,453 | 2/1986 | Kamio et al. | 72/201 X |

FOREIGN PATENT DOCUMENTS

| | | | |
|---|---|---|---|
| 1471847 | 3/1967 | France . | |
| 2552448 | 3/1985 | France . | |
| 57-156830 | 9/1982 | Japan . | |
| 0086922 | 5/1983 | Japan | 72/201 |
| 0030415 | 2/1984 | Japan | 72/201 |
| 60-43434 | 3/1985 | Japan . | |
| 60-206516 | 10/1985 | Japan . | |
| 60-206517 | 10/1985 | Japan . | |
| 145782 | 1/1970 | Netherlands . | |
| 1568483 | 5/1980 | United Kingdom . | |

OTHER PUBLICATIONS

F. Hollander, "Design and Control For Advanced Run-out Table Processing" Iron and Steel Engineer, Mar. 1971.

*Primary Examiner*—Henry A. Bennet
*Assistant Examiner*—Christopher B. Kilner
*Attorney, Agent, or Firm*—Stevens, Davis, Miller & Mosher

[57] ABSTRACT

A cooling system for cooling a metal strip moving horizontally along a roller conveyor has a plurality of water boxes (4) arranged between the rollers (1,2,3) of the roller conveyor and each having upwardly directed outlet ducts (6) from which cooling water is projected onto the underside of the metal strip. The ducts (6) are parallel to each other and uniformly spaced across the width of the strip. To improve cooling, particularly its uniformity, the outlet ducts (6) are all shaped and oriented so as to project the cooling water with a component of motion opposite to the direction of movement of the metal strip, and each water box (4) is shaped and located relative to the next preceding roller (1,2,3) in the direction of movement of the metal strip so that during operation the water projected from each water box also cools said next preceding roller.

5 Claims, 1 Drawing Sheet

COOLING SYSTEM FOR COOLING A MOVING METAL STRIP

BACKGROUND OF THE INVENTION

1. Field of the Invention

The invention relates to a cooling system for cooling a metal strip which is moving substantially horizontally along a roller conveyor e.g. in a steel-making plant. The cooling system comprises water boxes located between successive rollers of the conveyor, each water box having upwardly directed outlet ducts extending parallel to each other and at uniform spacing. The invention also relates to a water box for use in such a cooling system.

2. Description of the Prior Art

One cooling system as described above is known from Dutch patent no. 145782 in which FIG. 3 shows that the outlet ducts of the water box run with divergence from the vertical. However, since this publication does not indicate the direction in which the strip moves, the significance of the slant of the outlet duct is not clear. An article written by employees of the patentee in "Iron and Steel Engineer", page 84, March 1971, FIG. 6 shows that the slant of the outlet ducts is intended to be in the direction of movement of the metallic strip, so that water emerging also has a component of motion in the direction of movement of the strip. This direction of the slant of the outlet ducts is also found in all the installations actually built by the patentee and its successors in title, as well as in drawings and reports of the patentee only available internally.

The desirability of such a slant was accepted on the grounds of the cooling effect which it can give to the succeeding roller in the roller conveyor, and furthermore because it was thought that the impulse o the water jets directed in the direction of movement of the strip achieved maximum effect for intensive contact of fluid and strip surface.

However, new understanding has led to another configuration of the cooling system. It has been found that the movement of the fluid in the restricted space between rollers, water box and moving strip is extremely complex, partly because of the high velocity of rollers and strip, and it is also possible that the great differences in temperature between strip and water jet may play a role. It has been discovered that there exists water film which is not easily penetrable and has an inconsistent thickness on the under-face of the strip. This film is not easily controllable and leads to a likewise inconsistent and consequently undesirable or uncontrollable cooling effect.

It must be assumed that as a result of the complex water motion described, which at the same time partly causes atomization, the water film on the underside of the strip has a smaller thickness after the strip has left the preceding roller than when it runs onto the next roller.

This new understanding has given rise to the invention described below, and experiments have shown that, surprisingly, the new configuration of the outlet ducts leads to a better cooling effect.

Other prior art to be mentioned includes GB-A-1568483 in which water boxes have compressed air chambers for propelling the water as non-laminar jets. At the underside of the strip, the jets are inclined both forwardly and rearwardly with respect to the strip movement direction. No mention is made of the cooling of the rollers of the conveyor by the water from the jets.

JP-A-60-43434 discloses a cooling system for thick steel plate (not strip) having jets for directing cooling liquid onto both surfaces of the plate in the rearward direction. Gas jets prevent diffusion of the cooling liquid in the forward direction. FR-A-1471847 discloses another system for cooling steel plate or slab in which cooling fluid apertures are directed in both the forward and rearward directions. FR-A-2552448 shows in FIG. 16 a similar system, applicable to both plate and sheet.

SUMMARY OF THE INVENTION

The object of the invention is to provide a cooling system for moving metal strip which provides improved cooling of the metal strip, in particular more uniform and more controllable cooling. The invention is based on the new understanding described above.

The invention consists in that in the cooling system the outlet ducts are all shaped and oriented to give the cooling water a component of direction opposite to the direction of movement of the strip, and in that each water box is shaped and located relative to the preceding roller as viewed in the direction of movement of the strip, in such a way that during operation this preceding roller is cooled by the water box located directly after it. This cooling of the preceding roller may then also take place when strip cooling is not required and there is only a minimum flow of cooling water from the water box which is also enough to inhibit contamination of the outflow ducts.

The orientation of the outlet ducts in accordance with the invention can now achieve excellent and above all controllable cooling because the irregular water film formed by the velocity of the strip is effectively broken. A significant part of the sprayed water flows back downward onto the preceding roller. This has the effect of cooling this roller.

It has been found important for this roller cooling to occur regularly along the entire length of the roller because irregularly cooled rollers can otherwise cause more irregular temperature distribution over the width and the length of the metallic strip. It has been found possible to achieve a marked improvement in the uniformity of the cooling over the width of the strip by suitably shaping the top surface of the water boxes.

Consequently in accordance with the invention it is preferred that the water box has a top surface, at which exit mouths of the outlet ducts are located, which surface slopes downwardly in the direction opposite to the direction of movement of the metal strip to a drip edge which is located close to and above the surface of said next preceding roller. Water flowing down this top surface falls over the drip edge onto said next preceding roller. Furthermore, the water box preferably has, as seen in section parallel to the direction of movement of the metal strip, an undercut shape adjacent the drip edge, so that the drip edge is the extremity of a projection of the water box. The projection may have a groove in its undersurface close to the drip edge.

In this way practically all the water falling back from the strip collects on the top surface of the water box and from there flows over the drip edge onto the preceding roller. The drip edge distributes the flow of water evenly over the width of the roller. The regular and controlled release of the drip water is particularly improved by providing the groove in the under-surface of the projection. The top surface of the water box preferably extends at least from the outlet mouths of the outlet ducts to close to the surface of the next preceding roller.

The invention is especially applicable to the case where cooling is by projection of water onto the underside of the strip only. Further, the invention can employ laminar flow of the water from the water box, and can consequently employ a relatively low water pressure, e.g. about 2 bar, compared with jet-type apparatus. For this reason, preferably the outlet ducts are straight and of cylindrical shape and have a length at least twice their diameter, so that straight laminar flow of the cooling water is established in the duct.

The invention is further embodied in a water box suitable for use in the cooling system in accordance with the invention.

INTRODUCTION OF THE DRAWING

The invention will now be illustrated by reference to the single drawing which shows, by way of non-limitative example, an embodiment of the invention.

DESCRIPTION OF THE PREFERRED EMBODIMENT

Figure 1:
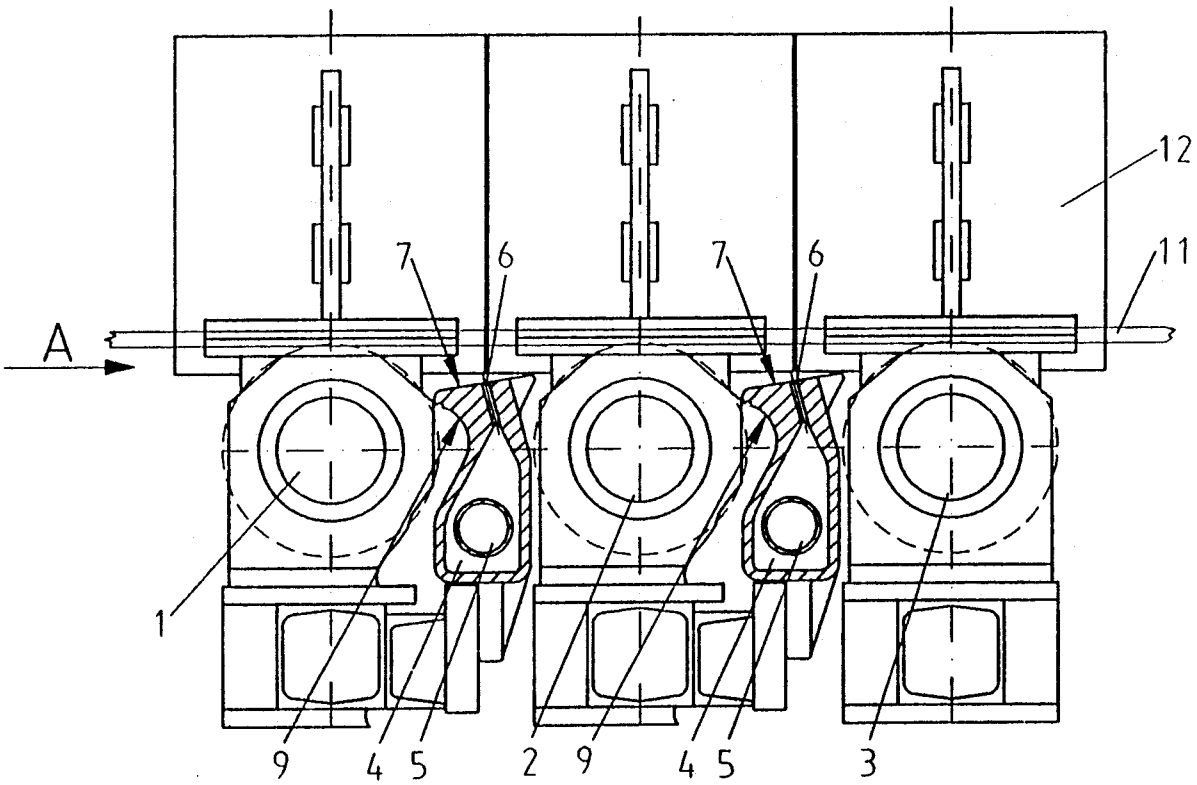
FIG. 1 shows in side view a portion of a roller conveyor provided with a cooling system in accordance with the invention.

FIG. 1 shows a side view of three rollers 1, 2, 3 forming part of a run-out roller conveyor for hot steel strip, which in conventional manner may consist of many more such rollers. The rollers are suitable for and designed for moving, in the conveying direction indicated by arrow A, a metal strip 11 arriving from a rolling device to the left, which is of a known type and thus not shown in drawing. The strip after cooling moves in the direction of a coiling installation to the right, which is likewise known and not shown in drawing. The circumference of each roller 1,2,3 is indicated by a broken line. FIG. 1 also shows side guides 12 for the strip.

One water box 4 is located between each adjacent pair of the rollers. Each water box 4 is provided with an in-flow pipe 5 for supplying cooling water (see also FIG. 2). In the part of the in-flow pipe 5 within the interior of the water box 4, holes are provided for allowing cooling water to flow out into the water box 4. The water box 4 is further provided with a large number of outlet ducts 6 for spraying cooling water towards the strip 11 in a direction determined by the ducts 6. The water boxes 4 are arranged between the rollers 1, 2, 3 so that the horizontal component of the direction of the cooling water is opposite to the direction of movement of the strip 11. The ducts 6 of each water box 4 are parallel and uniformly spaced across the width of the strip. Their axes lie in a common plane. Each duct 6 is cylindrical in shape and straight. Its diameter is about one-sixth of its length, so that straight laminar flow of the water is achieved at the exit end.

Furthermore each water box 4 is placed close to the preceding roller 1, 2 or 3 as viewed in the direction of movement of the strip in such a way that, during operation, this preceding roller 1, 2 or 3 is cooled by the water from the water box 4 located directly after it.

Figure 2:
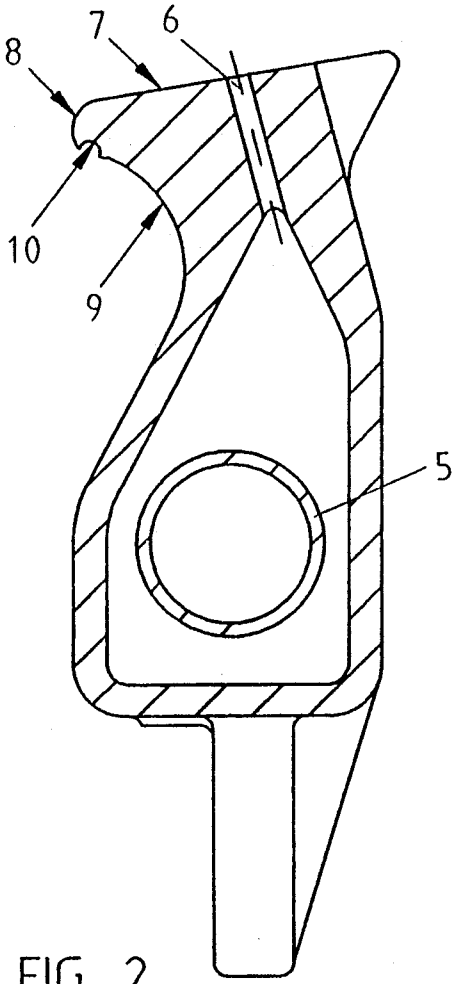
FIG. 2 shows in enlarged sectional view the water box of FIG. 1.

FIG. 2 shows that the flat top surface 7 of the water box 4 extends sloping rearwardly down, viewed in the direction of movement of the strip, to close to the surface of and above the centre of the next preceding roller. This top surface 7 passes via a drip edge 8 into the rear face 9 of the water box 4. The rear face 9 is undercut or receding, so that the drip edge 8 is the extremity of a rearward projection of the box located above the hollow water-containing region of the box 4. Water projected from the water box 4 and falling back from the strip 11 is thus collected by the surface 7 and guided over the drip edge 8 onto the roller. To assist the drip water to release in a controlled and uniform manner onto the roller, the water box 4 is also provided with a drip groove 10 at the underside of this projection. The drip edge 8 is spaced from the outlet mouths of the ducts 6 by a distance which is more than five times the diameter of the ducts 6. This ensures a suitable width of the surface 7, to collect the water falling back.

What is claimed is:

1. A cooling system for cooling a moving metal strip, comprising a roller conveyor for said strip having a plurality of rollers spaced in the direction of movement of said strip; and a plurality of water boxes arranged between said rollers in said direction and each having a plurality of outlet ducts for projecting cooling water onto said strip from below, said outlet ducts being parallel to each other and spaced uniformly across the strip width, and all said ducts in each box being oriented to project the cooling water upwardly and rearwardly relative to said direction of movement of said strip;

and wherein each said water box is located and arranged close to the next preceding one of said rollers, in said direction and has a top surface, at which exit mouths of said outlet ducts are located, which surface slopes downwardly in the direction opposite to the direction of movement of the metal strip and has a drip edge which is located close to and above the surface of said next preceding roller so that water flowing down said surface falls over said drip edge onto said next preceding roller.

2. Cooling system according to claim 1 wherein said water box has, as seen in section parallel to the direction of movement of the metal strip, an undercut shape adjacent said drip edge, so that said drip edge is the extremity of a projection of said water box, and wherein said projection has a groove in its under surface close to said drip edge.

3. Cooling system according to claim 1 wherein said outlet ducts are straight and of cylindrical shape and have a length at least twice their diameter, so that straight laminar flow of the cooling water is established in each duct.

4. Cooling system according to claim 1 wherein said outlet ducts are straight and of cylindrical shape and have a length at least twice their diameter, so that straight laminar flow of the cooling water is established in each duct.

5. A water box for a cooling system for cooling a metal strip moving horizontally along a roller conveyor, said water box being adapted to be located between two adjacent rollers of said conveyor and having a plurality of upwardly directed outlet ducts for projecting water onto the underside of the metal strip, said ducts being parallel to each other and having uniform spacing across the width of the strip, all said ducts being shaped and oriented so as to project the cooling water with a component of motion opposite to the direction of movement of the metal strip, said the water box having a top surface at which said outlet ducts have their exit mouths, which top surface slopes downwardly in the direction opposite to the direction of movement of the metal strip and has a drip edge bounding said surface, said drip edge being spaced from said exit mouths of the outlet ducts by a distance which is at least five times the diameter of said outlet ducts.

* * * * *